United States Patent [19]

Leonardis

[11] Patent Number: 4,831,803

[45] Date of Patent: May 23, 1989

[54] FOUNDATION FORM WORK

[76] Inventor: Nicola Leonardis, 23 Mayfred Avenue, Hope Valley, S.A. 5090, Australia

[21] Appl. No.: 111,041

[22] Filed: Oct. 20, 1987

[30] Foreign Application Priority Data

| | | | |
|---|---|---|---|
| Oct. 23, 1986 | [AU] | Australia | 562334 |
| Oct. 23, 1986 | [AU] | Australia | PH8650 |
| Jan. 16, 1987 | [AU] | Australia | PH9915 |
| May 15, 1987 | [AU] | Australia | PI1931 |

[51] Int. Cl.[4] ..... E04B 5/32

[52] U.S. Cl. ..... 52/323; 52/577; 52/585; 52/687

[58] Field of Search ..... 52/320, 323, 324, 576, 52/577, 582, 584, 585, 684–689, 285

[56] References Cited

U.S. PATENT DOCUMENTS

| | | | |
|---|---|---|---|
| 660,308 | 10/1900 | Pixley | 52/585 X |
| 805,665 | 11/1905 | Reagan | 52/585 X |
| 1,133,801 | 3/1915 | Hough | 52/320 |
| 1,160,384 | 11/1915 | Crane | 52/687 X |
| 2,916,909 | 12/1915 | Miller | 52/323 |
| 4,454,699 | 6/1984 | Strobl | 52/585 |
| 4,685,267 | 8/1987 | Workman | 52/577 |

FOREIGN PATENT DOCUMENTS

| | | | |
|---|---|---|---|
| 227917 | 6/1963 | Austria | 52/585 |
| 798240 | 11/1968 | Canada | 52/577 |
| 1565543 | 5/1969 | France | 52/577 |
| 24422 | 3/1914 | Norway | 52/323 |
| 395482 | 12/1965 | Switzerland | 52/577 |
| 1141691 | 1/1969 | United Kingdom | 52/323 |

*Primary Examiner*—D. A. Scherbel
*Assistant Examiner*—Richard E. Chilcot, Jr.
*Attorney, Agent, or Firm*—Oldham & Oldham Co.

[57] ABSTRACT

A building foundation form work arrangement in which a plurality of boxes 1 are located on a supporting level surface and are kept apart to leave channels 4 between the boxes 1, and spacers 22 engaging respective sides of each of the corners of the boxes 1 so as to hold these in position against substantial lateral dislodgement forces when concrete is poured into the channels 4.

15 Claims, 9 Drawing Sheets

67
1
1
68
4
65
66
6
69
1

FOUNDATION FORM WORK

BACKGROUND OF THE INVENTION.

1. Field of the Invention

This invention relates to building foundation form work including a spacer useful in form work, and a method of constructing and using form work for building foundations.

The problem to which this invention is directed is the present cost of providing a foundation for a building which will be sufficiently strong to resist substantially expansive soils.

2. Description of the Prior Art

It has been conventional to cut trenches into the ground and then subsequently pour concrete into these, and in some cases providing above ground form work so that concrete can be poured above ground level as well as below.

Such work in cutting the trenches and laying up the form work is extremely labour intensive but furthermore, substantially constrains the style of foundation that is most appropriate for a particular application.

In other words, on many occasions, especially where soil is known to be soft or expansive over different seasons, it would perhaps be better to have an integral slab on which the building would sit, but hitherto the cost of this would be equivalently so high as to make it in many cases impractical.

It has been previously known to propose form work and also to include rectilinear elements within a foundation form work so that concrete is then poured over these so that they are subsequently incorporated into the foundation.

Once again, the problem has been the cost of providing such elements which have been previously proposed as being constructed of polystyrene foam.

More recently a cardboard box has been proposed which has considerably reduced the potential cost of this part but there has been a major problem in respect of holding such cardboard boxes in relation one to the other in such a way that the boxes will retain with sufficient integrity their relative position especially during the pouring of concrete, and secondly such that any means that might be used to hold the boxes in a relative position do not of themselves unreasonably reduce the integrity of any foundation that is subsequently poured.

The problem in particular arises because of the inherent constructional characteristics of a cardboard box and the extremely high forces that result when concrete is being poured in a channel on one side of a box where there is no equivalent material on the opposite side of the box.

It has also to be remembered that such side pressure will be aggravated by vibration conventionally used by concrete pourers to ensure removal of voids within the foundation being poured.

SUMMARY OF THE INVENTION

After considerable investigation I have found that cardboard boxes of the type being discussed can be sufficiently held against such lateral pressures if there are means which engage against respective sides in the vicinity of the corner of the box.

This is achieved by providing a spacer therefore which engages against both sides of a corner of a first box, and at the same time against both sides of a corner of a second box adjacent the first, where the two boxes define therebetween a channel shape, and accordingly provide substantive resistance to such distortional pressures.

The invention accordingly can be said to reside in a building foundation form work arrangement in which a plurality of cardboard boxes are located on a supporting level surface, and are kept apart to leave channels between each side of each of the boxes by spacers within the channels between the boxes, at least one spacer engaging against both sides adjoining a corner of a first box, and at the same time against both sides adjoining a corner of a second box adjacent the first box.

In preference, the spacer engages against both sides adjoining a corner of each of four adjacent boxes with the corners at a common location.

In a further form, the invention can reside in the method of preparing a form work arrangement for the pouring of a foundation for a building which comprises the steps of locating within a boxed area and over a substantially level area of supporting surface, a plurality of boxes each of which are kept apart one from the other to leave channels between the respective sides of the boxes, locating within the respective channel shapes a spacer such that the spacer engages against both sides adjoining a corner of a first box, and at the same time against both sides adjoining a corner of a second box adjacent the first box, effecting support within the channels, on the spacer, of a reinforcement rod, and then pouring concrete into the channels and over the boxes to effect a building foundation.

One particular problem associated with locating spacers in the manner described is that these in some cases may aggravate a weakness in the structural strength of the foundation thus poured.

If for instance a concrete block is located midway between respective corners of the same box and this is supported on the ground within the channel, and furthermore this block has a width which defines the channel width and is used then as a block to support reinforcing rods, then it is found that this can result in a localised weakening of the concrete where the foundation concrete meets the concrete block material. If this does fracture, while not structurally necessarily dangerous, there can result access of water which through capillary action can reach the steel reinforcing rod or rods.

This can be avoided by ensuring that concrete for the foundation extends to form an integral portion of concrete below the main body of any spacer. This is achieved by providing that each spacer while having a substantially large outermost engaging surface to bear against the side of a box, nonetheless has frame members which have an lowermost edge which are substantially above a lowermost edge of such outermost engaging surface and as such above any supporting ground level surface.

In this way, much concrete is allowed to flow and set below such frame members thereby maintaining as much as possible the structural integrity of the concrete.

One further problem is the fact that in some cases the foundation will be required to be somewhat deeper than might be considered standard.

It has been found uneconomic to provide boxes which have substantially different heights as a range.

It has of course been proposed to provide that a conventional shaped box be located one upon the other to provide thereby a double thickness but the problem has been the same as hitherto experienced, that is, how does one resist sideways pressure when the foundation is being poured.

In respect of this invention, it is proposed that there be securing means locating respective corners of boxes for the purposes described where one of the boxes is located above a second box, defining together coplanar sides effecting a channel between such sides and other such boxes.

In preference, such securing means engage against both sides adjoining a corner of a first box and at the same time against both sides adjoining a corner of a second box where the first box is located above but resting on the first box.

The invention will be better understood when referred to preferred embodiments which shall now be described with the assistance of drawings in which:

BRIEF DESCRIPTION OF THE DRAWING

FIG. 6 illustrates an arrangement for spacing the box elements apart from corner locations.

DESCRIPTION OF THE PREFERRED EMBODIMENT(S)

Figure 1:
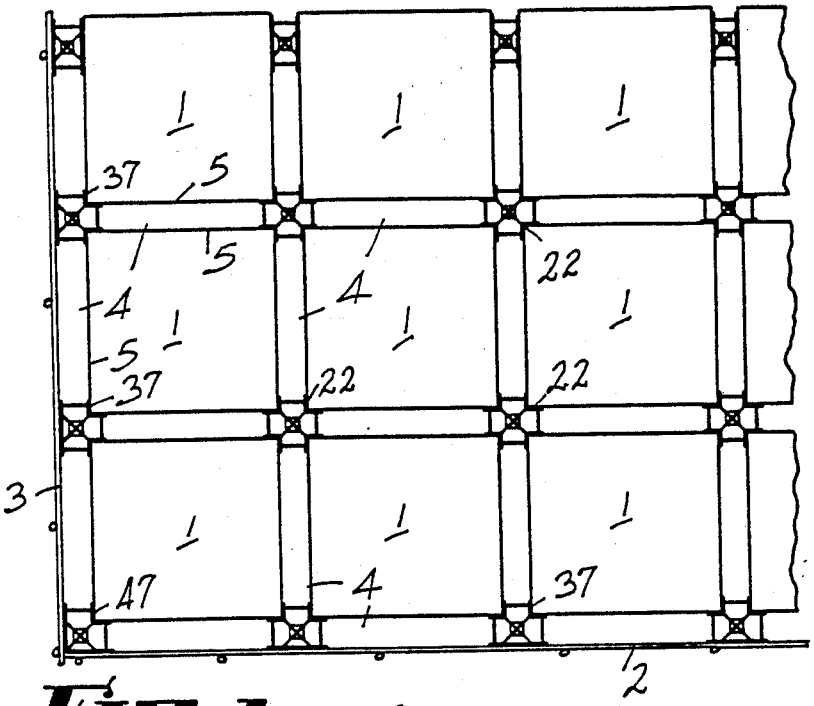
FIG. 1 is a plan view showing a typical building foundation form work arrangement incorporating this invention.

Referring in detail to the drawings, and in particular FIG. 1, there is shown here a plurality of boxes which are supported on level ground and which are surrounded by perimeter form work 2 and 3, the boxes 1 and the perimeter form work 2 all being held in spaced apart relationship so as to leave a plurality of channels 4 between the respective sides 5 of the boxes 1 and of course the perimeter form work 2 and 3.

Figure 2:
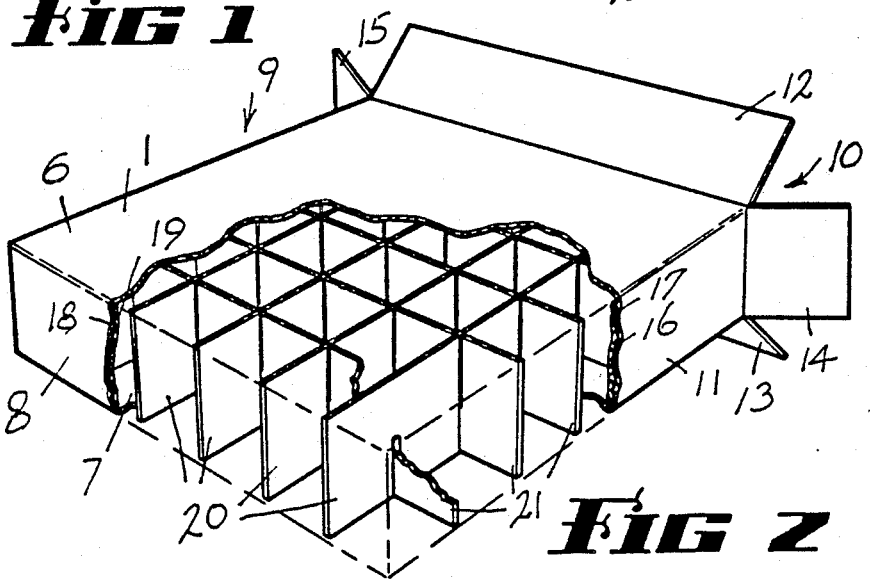
FIG. 2 is a partly cut-away and partially opened cardboard box as used in each of the embodiments.
Figure 3:
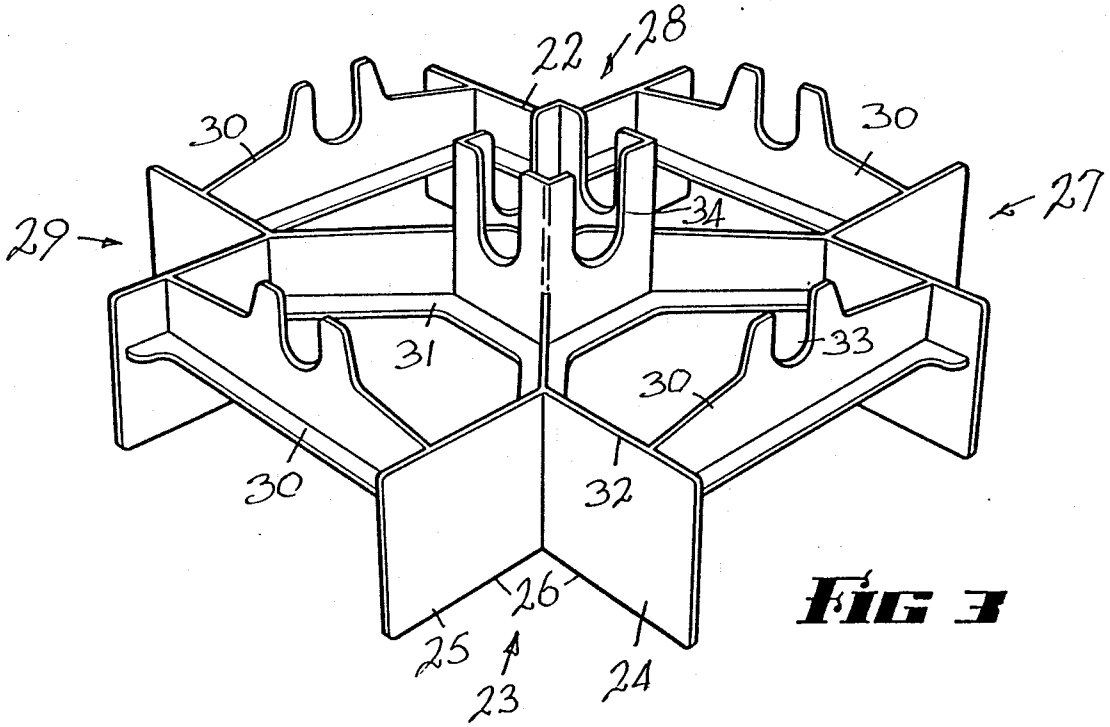
FIG. 3 is a spacer as incorporated within channels at a crossing over location and where four corners of respective adjacent boxes meet at a common location.

Each of the boxes 1 in particular as shown in FIG. 2 are comprised of cardboard having an external surface coated with an appropriate water repellant material such as a wax, but which otherwise comprise cardboard conventionally reinforced with a corrugated layer within each planar surface, the box 1 including a top 6, a bottom 7 and sides 8, 9, 10 and 11, the sides each defining a flat side and each being arranged to provide in plan, a square shape together with the flat top 6 and the flat bottom 7.

At side 10, this has been opened out to show a top flap 12, a bottom flap 13 and side flaps 14 and 15.

These are folded over so as to lie one against the other and to provide mutual reinforcing therefore for the side of the box thus formed.

In like manner, side 11 comprises two flaps one folded over the other, shown particularly at 16 and 17, and likewise side 8 has two flaps 18 and 19.

Internally, the box 1 is reinforced by typical egg-crate type reinforcement which comprises a plurality of transverse members 20 which interlock with crossing members 21 each of the members 20 and 21 being comprised of corrugated strengthened cardboard and each defining a vertical plane extending to immediately below the top 6 and above the bottom 7 so as to provide vertical support for the top 6.

In like manner, the ends butt against the respective sides and also provide at least some reinforcing strengthening of these.

Such reinforcement and strengthening is to such an extent that a foundation layer can indeed walk on top of the box and of course it is such that the boxes can resist lateral deformation under the stresses called for.

Each of such boxes 1 are located of course so as to leave channels 4 between the respective sides and in accord with this embodiment, there is provided a spacer 22 which in plan view is of cruciform shape but which provides at four symmetrically located positions a concave shape shown typically at 23 which has outermost engaging faces 24 and 25 which will engage against both sides adjoining a corner of a box 1.

It is of course necessary that there be a relatively significant bearing surface which can engage against an effective area of the side of a cardboard box, and furthermore such that this will engage both against an edge at the corner of a box and across the bottom of the box where there is also the bottom 7 which also provides additional reinforcing for the box.

Accordingly, engaging surfaces 24 and 25 are of substantial cross-sectional area (each being preferably 5.5 cms. wide and 5.5 cms. high) and are adapted with respect to the remaining parts of the spacer 22 to sit with lowermost edges 26 on the same level surface that is supporting the box 1.

There are of course in respect of the spacer 22, four such arrangements these shown further at 27, 28 and 29 and each of these being supported in the relative position which provides a concave shape defining the position of four corners of respective adjacent boxes by frame elements 30 and 31.

The respective frame elements 30 each are raised significantly above the ground level and indeed have an upper surface which lies flush with the upper surface 32 of the engaging surface typically at 24.

Midway and extending above such surface level at 32 is an open U-shape at 33 which is adapted to capture and support reinforcing rods.

There can be crossing rods and the height of the upwardly open U-shape slots both at 33 and in the centre raised portion at 34, are of sufficient height so as to indeed support in either way rods in one direction and then second rods in a crossing direction lying above a first rod.

Figure 10:
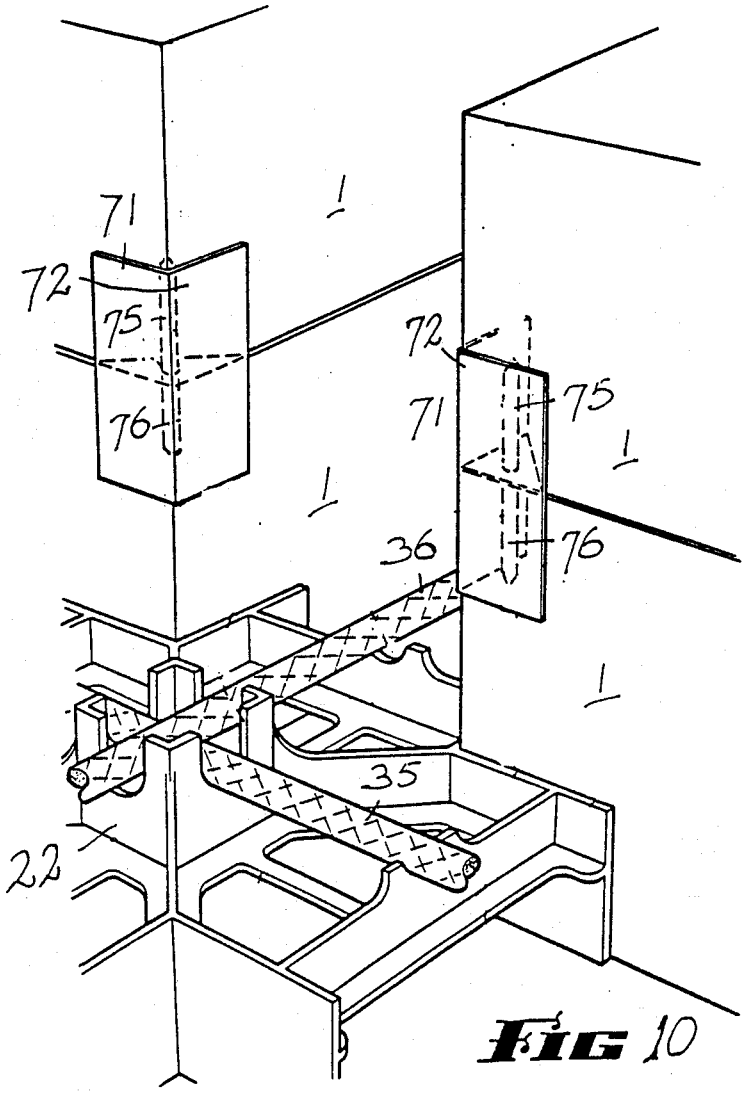
FIG. 10 illustrates in perspective detail the use of spacers to hold two boxes in adjoining relationship one above the other in combination with a general spacer as in FIG. 3.

Such an arrangement is best shown in FIG. 10 in which the rods are shown at 35 and 36, although the spacer in this case does not have such high sides for its open U-shape slot shape. The rods closely fit the width of the slot and therefore hold the spacers collectively tightly together. This holding effect is assisted where the rods crossover and the spacers then become tightly locked together.

The diagonal frame members 31 provide of course cross bracing, and also because of their general thickness will provide substantial support for such reinforcing rods, once again however being raised so as to be significantly above any ground supporting level so as to allow firstly for concrete to pass fully beneath such frame members, and also to ensure an effectively continuous thickness which will effectively resist localised fracturing under stress conditions and therefore resist capillary water egress to the metallic reinforcing rods.

Figure 4:
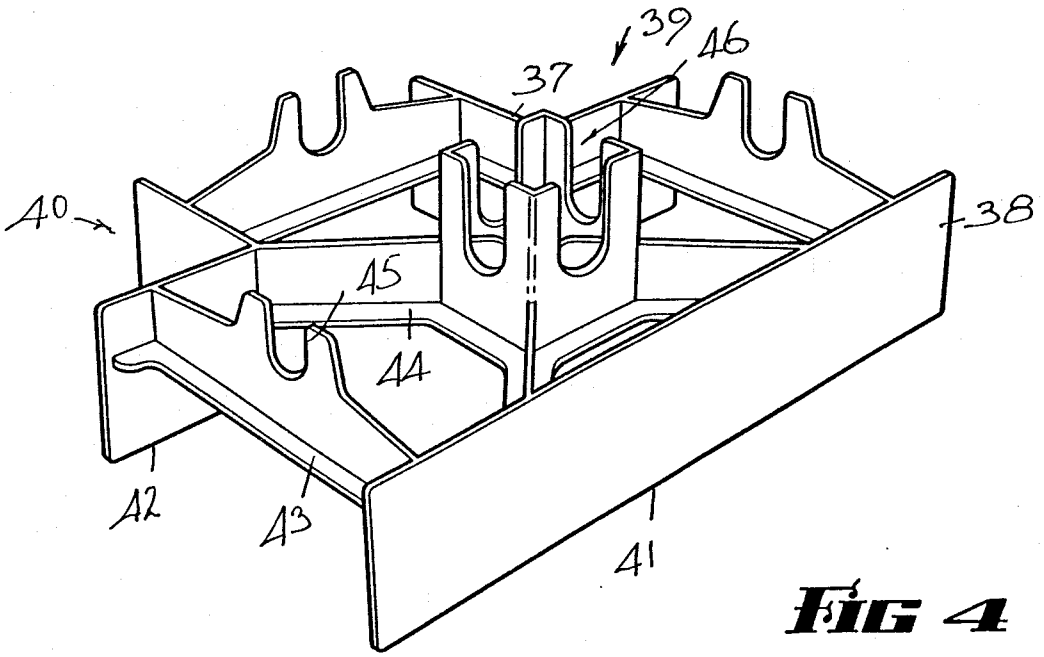
FIG. 4 is a spacer adapted to be used where two corners meets and there is a T-junction of the channels as shown in FIG. 1.

The spacer 37 as shown particularly in FIG. 4, and also illustrated in FIG. 1, is the same as the spacer 22 except that it has one side at 38 adapted to engage against perimeter form work only, thereby leaving two only concave portions at 39 and 40 to engage against both sides adjoining a corner of the respective boxes 1.

In the same manner, the bottommost edges typically at 41 and 42, are adapted to sit on the same level surface that the boxes 1 are adapted to sit on, and the frame elements 43 and 44 are all located well above such ground support to allow for concrete to flow fully beneath these and of such thickness to provide adequate support for openly upward U-shape slots 45 to the side and 46 at the centre.

Figure 5:
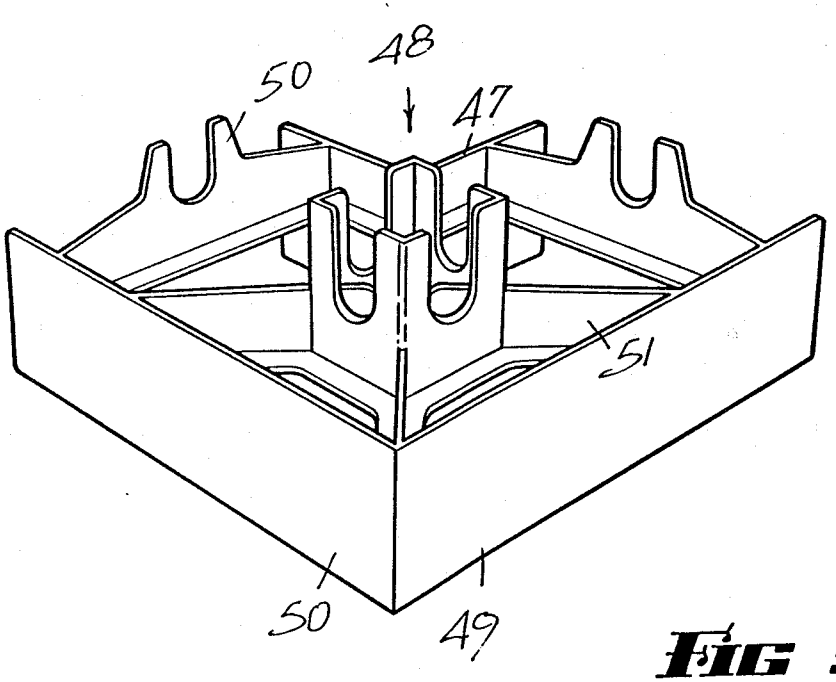
FIG. 5 illustrates the spacer when used with one corner of a box.
Figure 5:
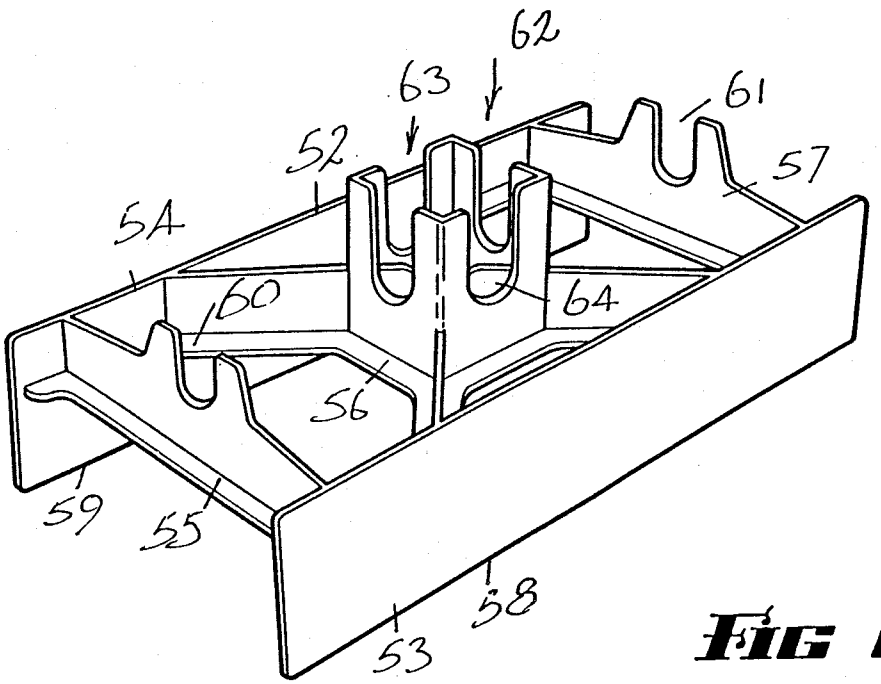
Figure 7:
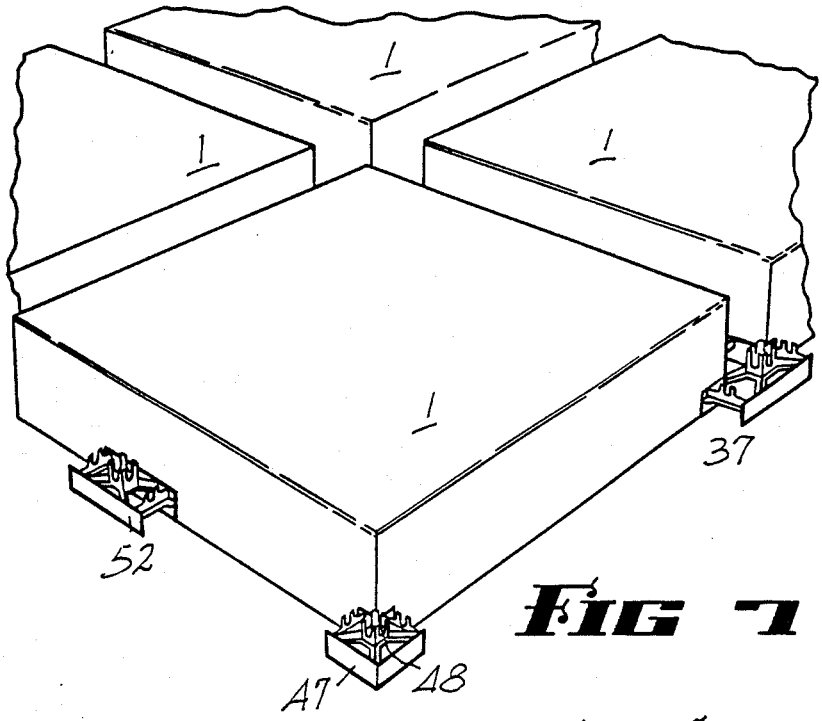
FIG. 7 is a perspective view showing the application of spacers as shown in FIGS. 4, 5 and 6.
Figure 8:
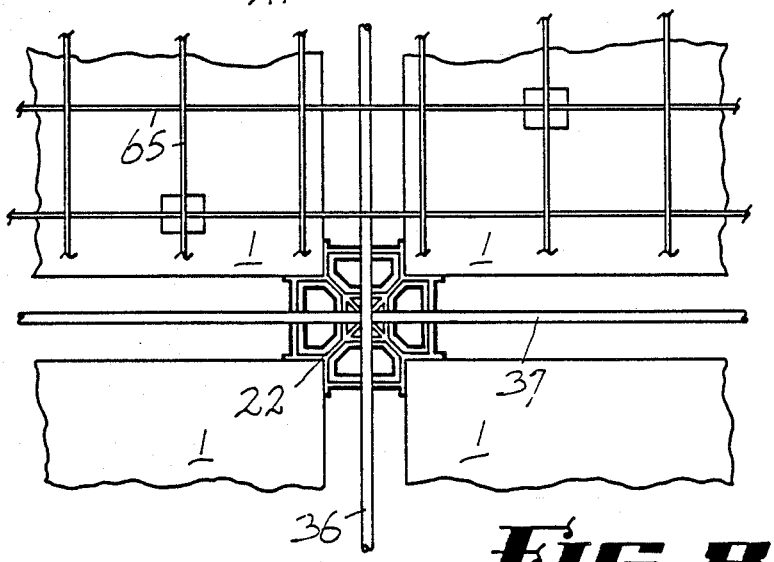
FIG. 8 is a plan view in some greater detail of a spacer as in FIG. 3 being used in conjunction with reinforcing rods and engaging against the adjacent sides of the corners of four boxes.

FIG. 5 in particular shows spacer 47 which has the same fundamental elements of the previous spacer but in this case has only one concave part 48, the remaining outer engaging surfaces at 49 and 50 being adapted to engage against the inner sides of form work such as at 2 and 3 in FIG. 1, and to also rest on the lowermost ground level surface so that frame members 50 and 51 are supported well above the ground surface.

In FIG. 6 there is a spacer 52 which is not engaging directly corners of boxes but includes two sides 53 and 54 each of the sides being of substantial area so as to provide substantial bearing surface against the sides of a respective box 1 but in each case, frame members 55, 56 and 57 are all located so as to be well above lowermost support level 58 and 59 so that concrete can fully pass and be continuous below the respective frame members 55, 56 and 57 which in turn provides for reinforcing at such positions at 60, 61 and 62.

The slots 63 and 64 are generally superfluous except for reducing the total quantity of plastic necessary in respect of each of these spacers which are in each case manufactured by injection moulding from an appropriate plastics material such as polypropylene.

In the application of the invention to a foundation, it is conventional to further provide steel fabric 65 which is supported by supports 66 resting on the top 6 of a box 1.

Figure 9:
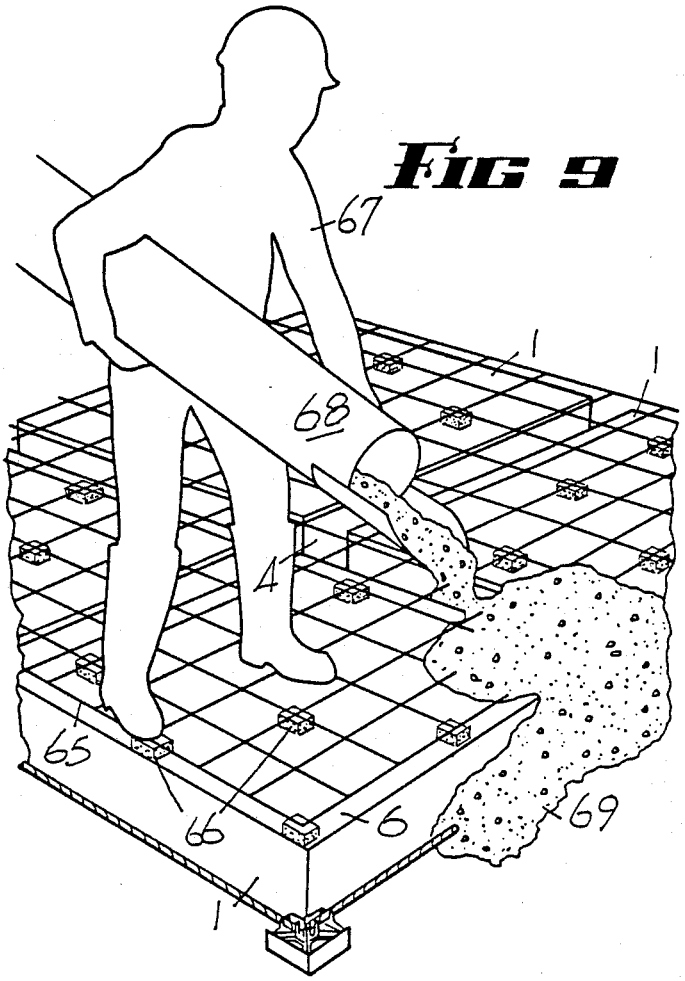
FIG. 9 is a perspective drawing illustrating the manner in which the form work is used and illustrating the technique for pouring concrete in channels formed between the respective boxes and over the top of these.

As shown in FIG. 9, a worker 67 can then step on the fabric 65 and support concrete outlet 68 whereby concrete 69 is effectively poured into the various channel shapes 4 and across the uppermost surface over the top 6 of the various box elements 1.

Figure 11:
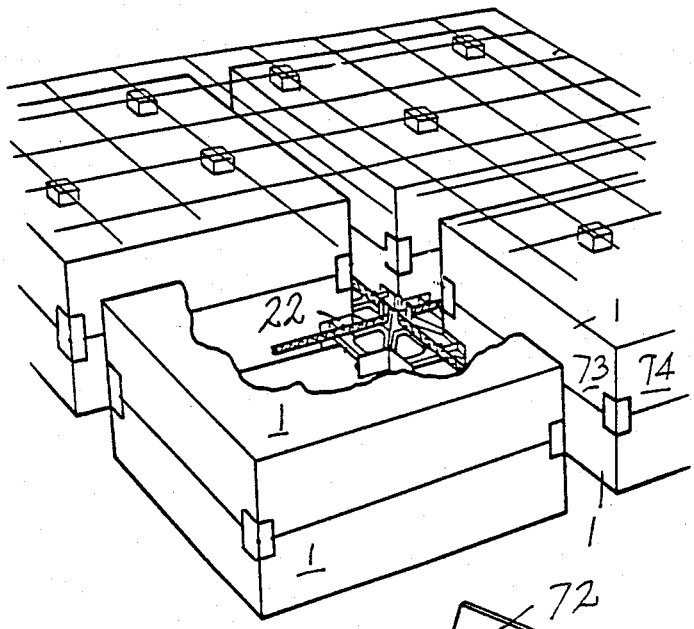
FIG. 11 is a more general view as shown in FIG. 10.
Figure 12:
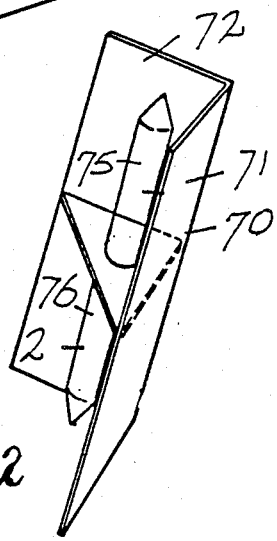
FIG. 12 is a perspective view of a spacer used when the boxes are one above the other as in FIGS. 10 and 11.

In FIGS. 11 and 12 there is a spacer 70 which acts to maintain the relative spaced relationship of boxes 1 when located one above the other.

This is achieved by having engaging faces 71 and 72 engaging against both sides typically at 74 and 75 of a box 1, and there being a spike 75 and a spike 76 located to be pierced through the respective top and bottoms at the corner position of the respective boxes 1.

These thereby positively locate and capture the respective boxes and hold them in a relative position one with respect to the other.

The method of using the elements described is of course to prepare ground as level, surround this with perimeter form work as at 2 and 3 and then locate sequentially, a variety of spacers as appropriate and then boxes 1 so that these extend fully across the defined area.

Boxes of different overall shape and area can be used if the defined area is not appropriately covered by the shapes described.

For parts of a building which are to be higher than others, these can then be provided with a higher foundation part by supporting one box upon the other and joining these in the manner described.

While the spacers have been described as being of plastic, these can be made from other compatible materials such as steel sheet which can be cut and folded into an appropriate shape.

This then describes the best method known at the present time of putting the invention into practice by the applicant.

I claim:

1. A building foundation form work arrangement comprising:

(a) a plurality of boxes located on a supporting level surface in spaced relationship so as to provide channels between adjacent boxes, each of said boxes having a plurality of vertical sides and corners formed at the intersections of adjacent sides, said channels being formed between adjacent sides of adjacent boxes;

(b) spacers within said channels, between adjacent boxes, each of said spacers including (1) outermost planar surfaces which are adapted to engage the sides of respective adjacent boxes, and (2) frame members for holding said outermost planar surfaces, the lowermost edge of each such frame member being substantially above the lowermost edge of each such outermost planar surface;

(c) said spacers including at least one spacer having a first pair of outermost surfaces engaging against both sides adjoining a corner of a first box and a second pair of outermost surfaces for engaging against both sides adjoining a corner of a second box which is adjacent to said first box.

2. A building foundation form work arrangement as in claim 1 further characterised in that said boxes are rectangular and said one spacer engages against each of two sides adjoining each of the corners of four adjacent boxes with corners at a common location.

3. A building foundation form work arrangement as in claim 2 further characterised in that each of the boxes has vertical reinforcing partitions within each of the boxes.

4. A building foundation form work arrangement as in preceding claim 2, further characterised in that the spacer is of a cruciform shape in plan and includes for each of eight sides of the respective boxes, an outermost engaging surface that is planar.

5. A building foundation form work arrangement as in claim 1 in which the boxes are each of cardboard.

6. A building foundation form work arrangement as in claim 1 in which each of the boxes has four sides, a top and a bottom, is comprised of cardboard and has extending in crossing interlocking relationship cardboard planar strips acting as vertical reinforcing partitions extending from a bottom of a respective box to a top of a respective box, and each from a first side to an opposite side of the box.

7. A building foundation form work arrangement as in claim 1 in which the spacer includes means to support and locate a reinforcement rod within a channel.

8. A building foundation form work arrangement as in claim 7 wherein the means for providing support for a reinforcement rod include a portion of the spacer that has an upwardly open slot.

9. A building foundation form work arrangement as in claim 1 further characterised in that there is at least one box located above another box and there is a joining spacer engaging against adjacent sides of a corner of a first of the boxes where this is a lowermost box, and against adjacent sides of the corner of a second of the boxes which is above the first of the boxes and wherein the said corner is above the corner of the first said box.

10. A building foundation form work arrangement as in claim 9 wherein the joining spacer includes two spikes, a first engaging within a first of the boxes and a second within a second of the boxes so as to hold thereby engaging surfaces against the respective sides of the respective boxes.

11. A building foundation work arrangement as in claim 1 in which said boxes are cardboard boxes.

12. A spacer for a building foundation form work arrangement wherein a plurality of boxes are located in spaced apart relationship to define therebetween channels, said boxes having a plurality of sides and corners formed at the intersection of adjacent sides, the spacer being characterised by including (1) first outermost planar engaging surfaces adapted to engage against both sides adjoining a corner of a first box, (2) second outermost planar engaging surfaces adapted to engage at the same time against both sides adjoining a corner of a second box adjacent the first box but spaced therefrom, and (3) a frame member extending between said first and second outermost engaging surfaces, said frame member having a lowermost surface which is substantially above a lowermost edge of each of the engaging surfaces such that concrete can extend contiguously beneath said frame member.

13. A spacer as in claim 12 further characterised in that the spacer is of cruciform shape in plan having thereby eight engaging outermost surfaces adapted to engage respectively against both sides adjoining a corner of each of four adjacent boxes with the corners at a common location.

14. A spacer as in claim 13 further characterised in that there is included an upwardly extending medially positioned part having an upwardly open U-shape slot therein adapted to support and hold a reinforcing rod thereby.

15. A spacer for a building foundation form work arrangement wherein a plurality of boxes are located in spaced apart relationship to define channels therebetween, said boxes having a plurality of sides, and corners formed at the intersection of adjacent sides, the spacer being characterized by including (1) outermost planar surfaces engaging against the sides of respective adjacent boxes, and (2) frames members for holding said outermost planar surfaces, the lowermost edge of each such frame member being substantially above the lowermost edge of each such outermost planar surface.

* * * * *